United States Patent [19]

Maier et al.

[11] Patent Number: 5,018,378

[45] Date of Patent: May 28, 1991

[54] MOLD MAKING

[75] Inventors: Ulrich Maier, Wallenhorst; Horst Fischer, Osnabrueck, both of Fed. Rep. of Germany

[73] Assignee: KM-kabelmetal AG, Osnabrueck, Fed. Rep. of Germany

[21] Appl. No.: 46,128

[22] Filed: May 4, 1987

[30] Foreign Application Priority Data

May 2, 1986 [DE] Fed. Rep. of Germany ..... 3615004
May 3, 1986 [DE] Fed. Rep. of Germany ..... 3615079

[51] Int. Cl.[5] ..... B21C 37/15
[52] U.S. Cl. ..... 72/283; 72/285
[58] Field of Search ..... 72/277, 283, 285, 370

[56] References Cited

U.S. PATENT DOCUMENTS 2,134,620 10/1938 McLay ..... 72/370
4,653,306 3/1987 Lazzerini ..... 72/283
4,722,213 2/1988 Enkvist ..... 72/285

*Primary Examiner*—Lowell A. Larson
*Attorney, Agent, or Firm*—R. H. Siegemund

[57] ABSTRACT

Molds for continuous casting machines are made by providing a plurality of different tubular blanks of copper or copper based alloys; selecting a particular blank and feeding same to a first working station in which the blank is provided with a thrust mount such as a rim against which a mandrel to be inserted can abut during subsequent working; a particular mandrel is selected from among a plurality of stored mandrels and forced into the rimmed tubular blank; by means of a die, the tubular blank is forced onto the mandrel in all around, tight, surface to surface contact while preferably a normal orientation of the die is maintained in relation to the mandrel passing through; thereafter the mandrel is recovered from the blank and either returned to the station of mandrel insertion or to the mandrel store.

5 Claims, 3 Drawing Sheets

SR
SD
I
II
III
IV
V
P
1
2
3
4
5
6
7
8
9
10
1'
4'

MOLD MAKING

BACKGROUND OF THE INVENTION

The present invention relates to the making of molds for continuous casting machines, which molds are to be made of copper or copper alloys; more particularly, the present invention relates to the making of a mold, using a tubular copper or copper alloy blank, which tubular blank is shaped by means of a mandrel, as well as by means of forces acting on the tubular blank from the outside, which mandrel has the final dimensions and/or complementary contour of the internal contour of the mold to be made; the mandrel, of course, is to be removed following the forming and shaping process.

A method of the kind to which the inventions pertains and which is approved upon presently, is basically known through German Pat. No. 1,809,633 (see also U.S. Pat. No. 3,646,799). In accordance with this prior publication, an originally straight tube is forced, for example, onto a mandrel, which is curved, and has also the dimensions of the mold to be made. The tubular blank is just a little larger than the mandrel following forcing the tube onto the mandrel; together they are passed through a die by means of which the tube is now drawn onto the mandrel. Basically, this method is very valuable and many molds at the requisite accuracy and surface quality have been made in this fashion, particularly molds for continuous casting of steel have been made in this manner. The molds, particularly on account of the drawing process, have indeed sufficient hardness.

However, it was found that this mold making procedure when considered just by itself is quite expensive, and the manufacture is rather cumbersome and requires extensive machinery and trained personnel. Moreover, for improving the economy of existing casting machines, one has to an increasing extent larger molds.

Another factor having to do with the economy is that the down time of a machine is to be reduced. This means, molds should have a long use life and not require frequent exchange because during mold changing the machine itself is idle. This, of course, means that the use life of a mold has to be increased, and for this, in turn, it is necessary, to increase inter alia the hardness of the mold material. Also, the true-to-shape conditions are to be improved. On the other hand, it is apparent that an increase in hardness, particularly of a copper based mold material to be continued, with increased accuracy as to shape, means that the shaping forces generally for such a mold will have to be increased.

DESCRIPTION OF THE INVENTION

It is an object of the present invention to improve the making of a mold for continuous casting whereby particularly no constraints with regard to dimensions and cross-sectional contour should exist, while, on the other hand, the economy of such a mold-making, as well as the quality of that product in terms of uniformity and probability of expecting consistently a high quality, should be increased. These features and requirements should remain independent from any particular cross-section, wall thickness, as well as hardness requirements.

In accordance with the preferred embodiment of the present invention, it is suggested to store a plurality of usually different size tubular blanks made of copper or copper alloy, and to store separately a plurality of different mandrels each commensurate with a type or kind of mold to be made and sequentially each on these tubular blanks is worked as follows. In a first working station the tubular blank is provided with a stop and support for a mandrel to be inserted. In a second work station, a sizing mandrel selected from the store is inserted into that tube. In a third station, the tubular blank is drawn and "ironed" onto the mandrel by means of a die, and in a fourth station the mandrel is removed and is either returned to the second station or to the store, while the sized tube is past on either for further working, or storage, or shipping or a combination thereof.

These operating steps in combination and in their totality permit an economic manufacture with improved quality of the final product. This is particularly true for the making of tubular molds for continuous casting which are larger than normal, or when a material is being used that is harder than normal. The manufacturing can be carried out semi-automatically or even completely automatically, and can be adapted to fill a larger variety of different orders. Most importantly, specific manual manipulation is avoided, and the method, therefor, becomes independent from manipulatory skill (or lack of it).

Among other advantages, the inventive method permits a rather free selection of filling an order, or a portion of orders, within program of filling customer orders, whereby particularly one can switch from one order to another with little or no interruptions, refurbishing or the like. The prerequisite for a smooth filling of various orders within a program is an adequately filled storage facility for tubular blanks that encompasses such a variety to be in accordance with any and all of kinds of orders to be expected. Of course, the number of blanks must be adequate in order to avoid shortages. In principle, the store for blanks is a kind of buffer which decouples the tube-blank making from the mold making. These blanks may have a particular length or vary in length; they can all be straight, or some can be straight and some can be curved. The tubular blank, preferably, have been made by drawing, but rolled or cast tubular blanks can also be used in principle.

Turning to some details, in the first station, one end of a blank is preferably provided with an integral inwardly extending flange, bead or rim to serve as a thrust mount for a subsequently inserted mandrel. Alternatively, one can provide an auxiliary short mandrel or one can taper that one end of the tube. A stop is needed in order to avoid that the principle working mandrel will later be forced through and out of the blank during the drawing in the third station. As stated, beading or flanging as described is deemed preferred. It is important for practicing the invention successfully, i.e. the shaping of a tubular blank into a tubular mold, particularly by way of cold working, that one obtains both, a high quality commensurate with various requirements expected to be made on the mold, as well as a highly accurate size and shape of the internal dimensions and contour for the mold.

Specific quality aspects are the strength of the tube wall, the surface quality, particularly its smoothness inside and, which will become the surface for the mold. These qualities obtain by means of a mandrel which is inserted in the second station, having outer dimensions, which are, so to speak, a negative replica of the dimensions of the mold cavity to be made. Usually, one will force the mandrel into the tubular blank but this requires little or no force, if mandrel and blank are straight and if the blank is a little oversized. The same molds, if both are curved, then some force is needed when the blank is straight and the mandrel is curved. The degree of force needed is, of course, dependent upon the size differential, i.e. the difference in the outer diameters and outer dimensions of the mandrel in general, and the internal dimensions of the tube or blank. Generally it was found more practical to permit very little play which then, of course, requires forcing the mandrel into the tube or blank.

The desired mandrel quality obtains also through the die through which the mandrel plus tubular blank subassembly is forced. It is important here that the die makes sure of a complete surface to surface contact between mandrel and the tubular blank. It does not make any difference in principle whether or not the mandrel plus tubular blank subassembly is forced through the die by way of pushing or whether the tube plus mandrel sub-assembly is pulled through the die. Also, it is not essential in principle, which part is moved and which part remains stationary, that is to say, one can hold the mandrel plus tubular blank sub-assembly stationary, and push and/or pull the die over and along this sub-assembly.

Tight press forcing the internal surface of the tubular blank upon the mandrel permits manufacture of straight or curved, conical or partial conical molds for continuous casting which will attain and retain the requisite dimensions, and the surface quality as well as hardness will be high, sufficient to guarantee a long use life, particularly when the molds are used for continuous casting of steel. Moreover, the manufacturing is such that these desired qualities and properties will remain consistent.

In furtherance of the invention, the position and orientation of the die is controlled in dependence upon the curvature of the mandrel and/or of the blank. The cold working force of the die should act strictly normal to the surface of the respective mandrel portion directly in line with that force. This permits a very uniform changing, for example, in thickness of the tube even if the shaping and forming forces are quite high. It is particularly important that through this control the tube wall as formed remains free from internal tension. Such elimination avoiding mechanical, internal tensions in the tube wall, was found to be significant for increasing the use life of the mold. The continuous position control of the die with respect to its operating position requires that the die's position be adjusted during the shaping. This is particularly necessary for compensating any lack of uniformity in the wall thickness of the tube, or if differently thick blanks are used but the final product is to have the same wall thickness throughout. The angular position of the die on account of the control, can vary to wide degree. Angle adjustments in relation to a mandrel center axis are not possible in equipment that is known, for example, through the German Pat. No. 21 54 226 or the European Pat. No. 60,820. The automatic adjustment of the die in direction of the curved mandrel could lead to non-uniform material displacement as a result of the shaping process and, therefor, to non-uniform reduction in material. Drawing the tube onto a curved work tool surface by engaging it somehow from the outside, would not help, particularly where the principle problem is the accuracy of the dimensions and size of the inner surface of the mold to be made.

In furtherance of practicing the invention, the die should be pivotably mounted and be pivoted during the shaping and drawing process. Thus, in any given instant, the shaping portions of the die will be positioned to act normal to the surface of the mandrel which ensures uniform shaping of the mold wall to be. Generally speaking, the die should be guided and positioned so that the relative movement between die and mandrel to run in any given moment runs in the direction of the axis of the mandrel at the axial point (radial plane) of die-to be interacted regardless if the mandrel is straight or curved. Tubular blanks may in cases exhibit certain eccentricity in the wall thickness owing to certain tolerances in blank making. The inventive method through the controlled position adjustment of the die compensates for these non-uniformities in blank material.

The die itself is mounted in a holder, and controlled positioning of the die into a normalized position vis-a-vis the mandrel surface, is carried out by exerting certain forces onto that die holder. The die holder is pivotable or rotatably mounted, while the die relative to the die holder remains stationery in a stable position. It is of advantage here to use hydraulics owing to the high shaping forces which the die must take up and owing to the die holder adjustment and positioning. The holder itself must be held to take up these forces. The invention permits attainment of a high quality of a product in an economical fashion. For this, particularly, one will control the die as to its working position in a programmable fashion. The tube dimensions, wall thickness, physical characteristics of the material, mandrel and curvature, are all parameters determining the position of the die, particularly in dependence upon the mandrel curvature and that is automated in a predetermined fashion. A suitable input for the control may involve tracking of forces which the die holder exerts upon its mounting frame.

The tube shaping is preferably a cold working process, and involves degrees of deformation between 15 and 25% relative to the cross-section of the tubular blank.

The tubular mold that has been made is, as usual, a little too long and has to be trimmed to the final length dimension, while particularly the flanged or bearded end, for example, has to be removed. Following a quality control, the mold may be stored or shipped in accordance with the manufacturing or order program. Some additional work, however, may be required such as milling or otherwise cutting grooves into the tube walls to serve as suspension grooves.

The invention can be practiced for any kind of cross-sections, for the mold to be made and can be regularly circular, but also rectangularly, polygonal, square-shaped, or the cross-section may be more complex, such as T, double T, U or L-shaped. The mandrel, of course, has to match these cross-sections, because ultimately the mandrel determines the internal cross-section of the mold. In addition, the mandrel may be conically or double conically-shaped, to ensure conicity of the interior of the mold. As stated earlier, the mandrel can be straight or curved. One constraint that exists is, of course, of a practical nature; the mandrel must be removable from the mold. However, even this constraint is not as severe as it may sound, because one can make the mandrel as an assembly of different parts. Following the mold making the mandrel is disassembled in the mold and the parts are removed separately, thereby moving mandrel parts around internal corners or the like.

DESCRIPTION OF THE DRAWINGS

While the specification concludes with claims particularly pointing out and distinctly claiming the subject matter which is regarded as the invention, it is believed that the invention, the objects and features of the invention, and further object, features, and advantages thereof will be better understood from the following description taken in connection with the accompanying drawings in which:

Proceeding now to the detailed description of the drawings, FIG. 1 illustrates a store SR in which a sufficiently large number of tubular blanks are stored. They have certain desired dimensions and are of sufficient length and wall thickness. These dimensions basically depend upon the manufacturing program expected to be fulfilled. Among them and in each instance, a suitable one such as 1 is selected and fed to a station I. Station I provides the end of the tube or blank 1, i.e. with a suitable inwardly extending bead, rim or flange 2. Here, particularly, one will clamp the tube 1 into a working position and by means of a suitable punch that one end of the tube is upset. The beaded tube 1 is next fed, by means of a suitable transport device and equipment, to the station II, while simultaneously, a suitable mandrel is selected from a store of mandrels SD and is fed to the station II.

The station II, basically, is comprised of a press or punch bench by means of which the curved mandrel e.g. 3, that has been selected, is forced into the presumed straight tube 1. This way tube 1 at least in a kind of rough "approximation" assumes basically the overall curved contour of the mandrel. A second possibility, of course, is that one selects an already curved blank 4 in store SR, flanges or beads in station I, and feeds the curved tube 4 with flange rim or bead to the station II, wherein the mandrel can now simply be inserted assuming that tolerances exist of sufficient magnitude, i.e. the diameter differential between mandrel and curved blank is sufficient.

Figure 1:
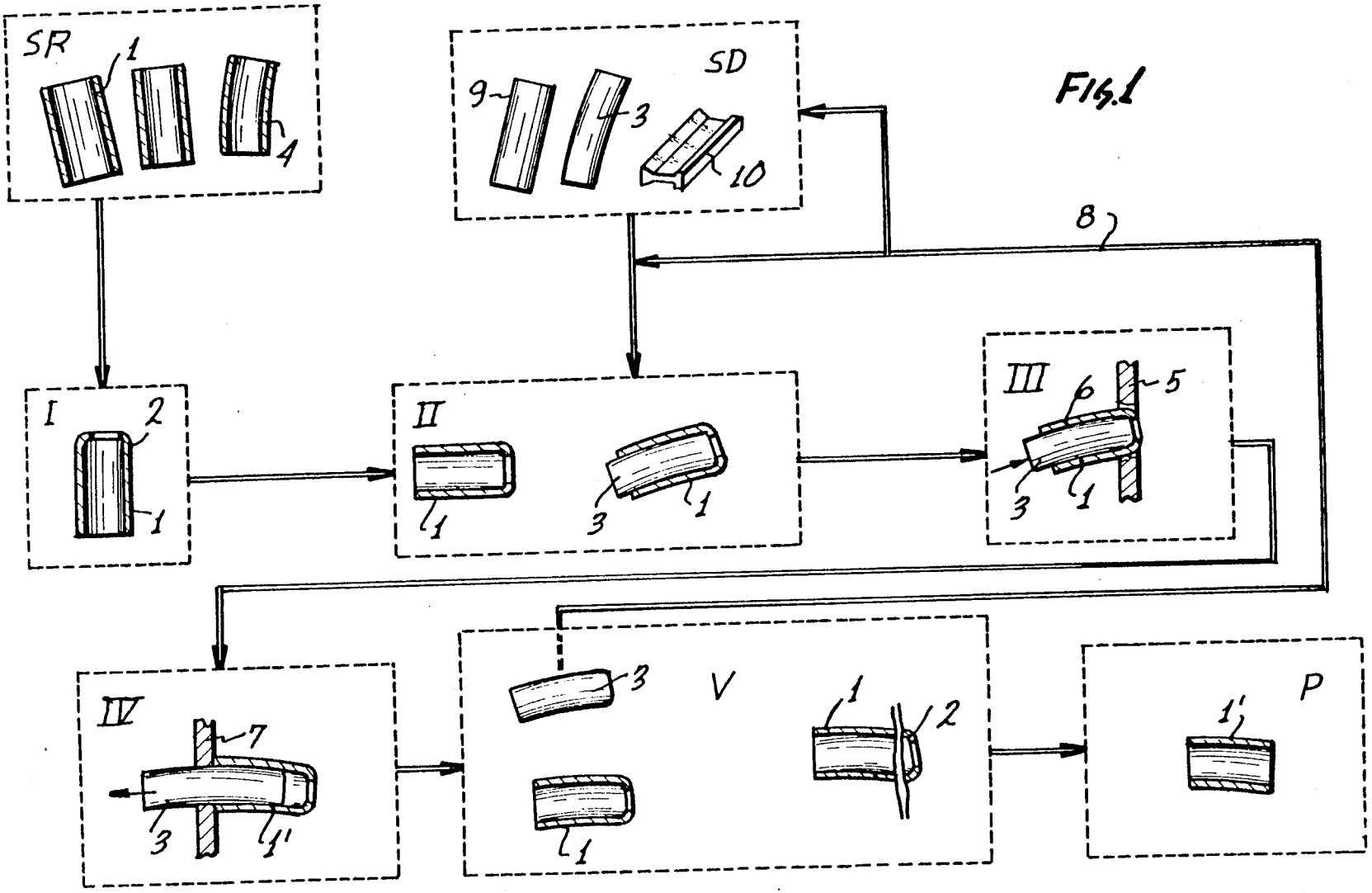
FIG. 1 is a diagram of working stations for explaining the mold making method in accordance with the preferred embodiment of the present invention for practicing the best mode thereof.
Figure 2:
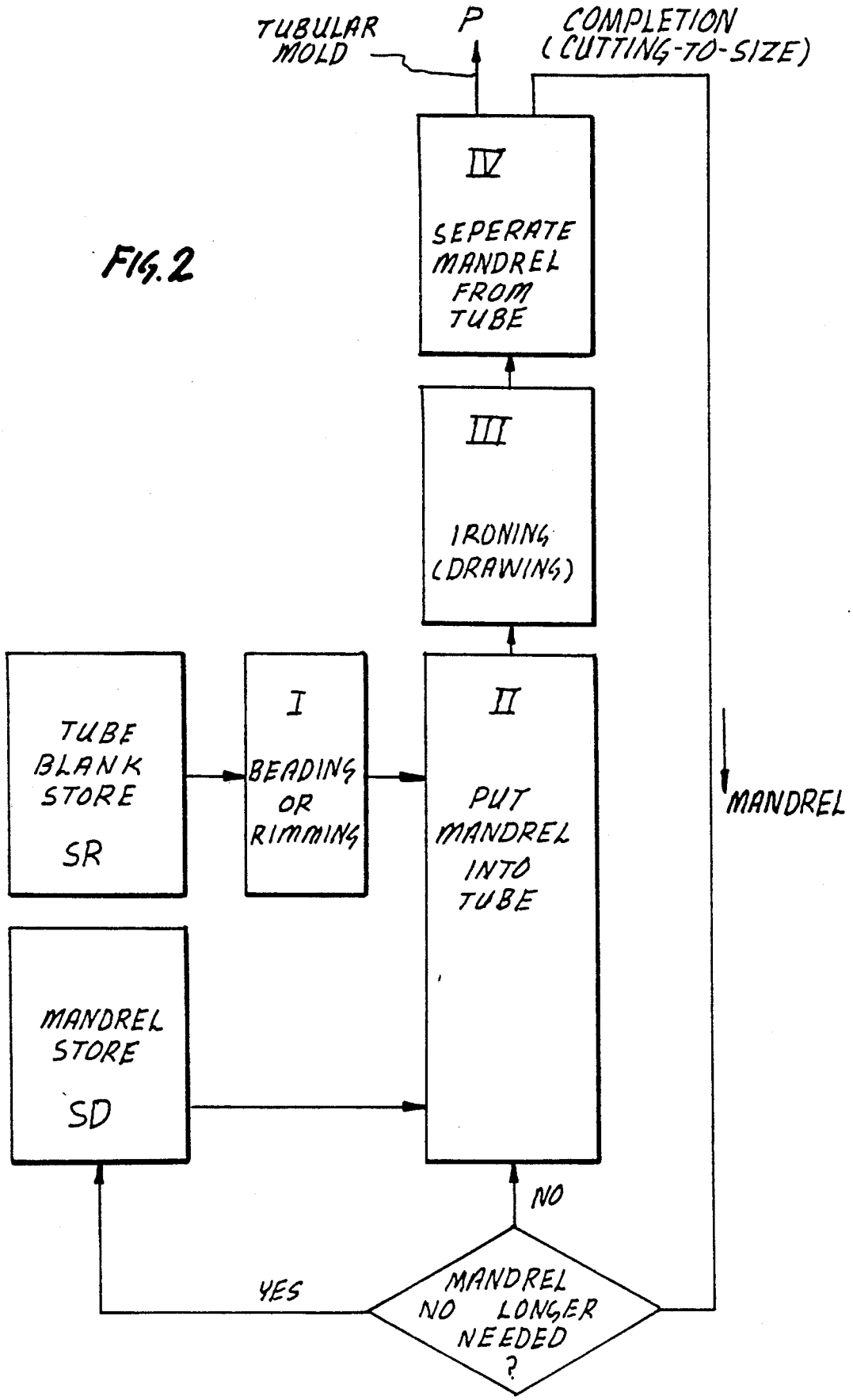
FIG. 2 is a flow chart pertaining to the system shown in FIG. 1 for explaining the passage of parts through the various stations.

Independently from the association of mandrel and tubular blank, i.e. independently whether both are curved or not, the decisive shaping occurs in station III. Herein, the tube 1 (or 4) is applied and drawn (ironed) onto the mandrel 3 by means of the die 5. In this particularly illustrated example, the sub-assembly 1–3 is pushed through the die in the direction of the arrow 5' in FIG. 1, whereby the inner surface 6 of the tube 1 is tightly forced onto the surface of the mandrel 3. In other words, the outer dimensions of the mandrel are, so to speak, copied in a negative or inverted fashion onto the inner surface of the tube. Simultaneously, the wall of the tube undergoes deformation, such that strength and hardness of the material increases drastically.

Further working of the preliminary mold 1' requires, for example, first certain standard dimensions such as determining the final length, and quality control. For this, the mandrel 3 is removed in station IV from the semi-finished mold 1'. This, for example, is carried out by means of a stripper serving as thrust mount 7 for the mold/tube 1' whenever the mandrel 3 is forced out of the interior of that tube 1' and in the direction indicated by the arrow 7' in station IV.

Following the mechanical and physical separation of the mandrel 3 from the tube 1', the mandrel 3 is either returned to the station II, if a similar kind of mold or several of them are to be made. Otherwise the mandrel is returned to the mandrel store SD. The symbol ST stands for this decision making process. Reference numeral 8 refers to a suitable transport path for the mandrel. Depending upon the continuation of the program, straight or curved or other molds may have to be made such as molds with double T sections. One may wish to use a straight mandrel 9 or a mandrel 10 with complex cross-section.

The tube 1' has now its beaded end 2 cut off in station I and there may be an end finishing or cutting of the mold to the desired length dimension, following which the basically completed mold is fed to a quality test station P. If it passes the quality test, then it will be packaged and shipped.

FIGS. 3, 4, 5, and 6 show details of certain aspects in the mold-shaping process. Shaping a tubular blank 11 into a mold or tube requires suitable selection of the material, and here, for example, a continuously cast round which has been drawn into a specularly reflective straight copper tube 11, with a Brinell hardness HB between 55 and 75 may be used. Depending upon the length of the mold to be made, this tube 11 has been suitably cut with, of course, certain additional length increments added so as to take care of the working process.

Figure 3:
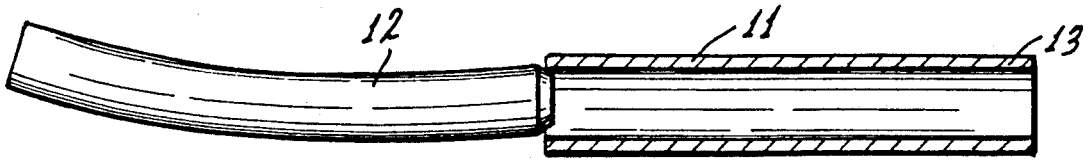
FIGS. 3, 4, 5, and 6 are sections, as well as schematic drawings, showing and demonstrating the position control of the die during practicing of the invention.
Figure 4:
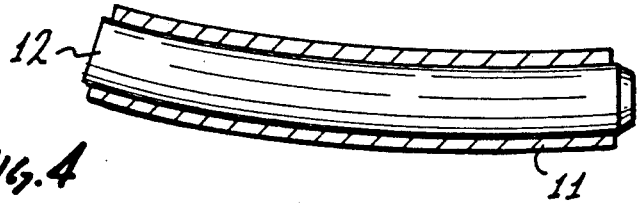

As shown also in FIG. 3 and 4, a hard mandrel with chromium coating or plating is forced into this tube. The mandrel, as stated, has the dimensions of the mold to be made, including the requisite curvature, if the mold is to be used for curved casting. Of course, also here in this case, the tubular copper blank can be precurved already to facilitate insertion of the mandrel. Suitable play and dimensional differentials are chosen for ease of this insertion, as was already mentioned above. Also shown here is that copper tube 11 is provided at its end 13 with a bead or inwardly directed flange against which the mandrel will abut after insertion. Instead one could use a pin or bolt or one could just taper the end of 13 of the tube 11.

FIG. 4 illustrates the completed sub-assembly of the inserted mandrel 12 with surrounding copper tubing 11, which at this point, may loosely fit onto the mandrel or there may be certain points of engagement owing to the fact that the mandrel had been forced the tubing 11 into a curved configuration. Next, this sub-assembly 11-12 is fed as to the deforming station (III in FIG. 1) and shown in FIG. 5. This particular station includes a deforming device 14, being comprised essentially of a frame 15 and a die holder 17, which is pivotally mounted onto the machine frame 15. Reference numeral 16 schematically indicates the pivoting or turning mount, and the frame 17 holds firmly a drawing die 18. Reference numeral 19 refers to hydraulic drives bearing against the mount and frame 15, and being capable of pivoting the die holder 17 about the pivot mount 16, to thereby change the orientation of the die, as indicated by the arrows.

Figure 6:
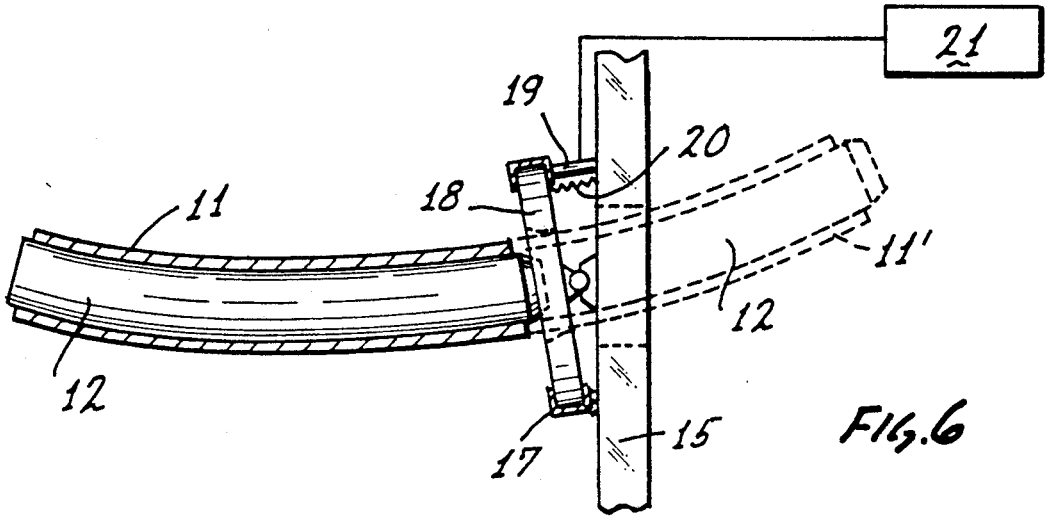

FIG. 6 now demonstrates operation of the device, indicating particularly that during passage of the sub-assemblies 11 and 12 through the die 18 the die can be oriented in any instant such that its plane of action traverses the center line of the mandrel or the local axis of that portion of the mandrel, then passing through the die at right angles. This is independent from the mode of operation in the sense whether the sub-assembly 11 and 12 is pushed through or pulled through the die 18. The "normal" position is understood here, also to be an ideal position and may be such that the center axis of the die coincides with a tangent on the center line of the mandrel at the point of intersection with the radial plane defined by the radially inwardly acting die rim.

When the die forces, presses draws or irons the tube 11 onto the mandrel 12, the deformation will be strongly controlled by this orientational adjustment of the die, whereby particularly axial local symmetry is a primary goal which will result in a uniform distribution of internal tension in the tube 11 as it emerges as a mold 11'. This, as stated above, is highly beneficial for the use life of the mold. This particularly is the more pronounced, the larger the dimensions of the mold 2, and the harder a material is used for that purpose.

As the sub-assembly 11, 12 is forced through the die, the orientational adjustment can also be interpreted in that the active portion of the die acts strictly normal on any point on the surface of the mandrel in radial alignment with the die and, therefore, causes the flow of material of the copper tube 11 to offset any irregularity as far as the tube 11 and its local wall thickness is concerned, so that a fixed and predetermined wall thickness obtains at uniformly distributed stress and strain conditions therein. The forces act on the curved mandrel in local directions that are strictly normal to the mandrel surface which ensures that the resulting mold 11 has exactly the desired dimensions, and the Brinell hardness will increase from the original value up to at least 80 and possibly up to 100.

Figure 5:
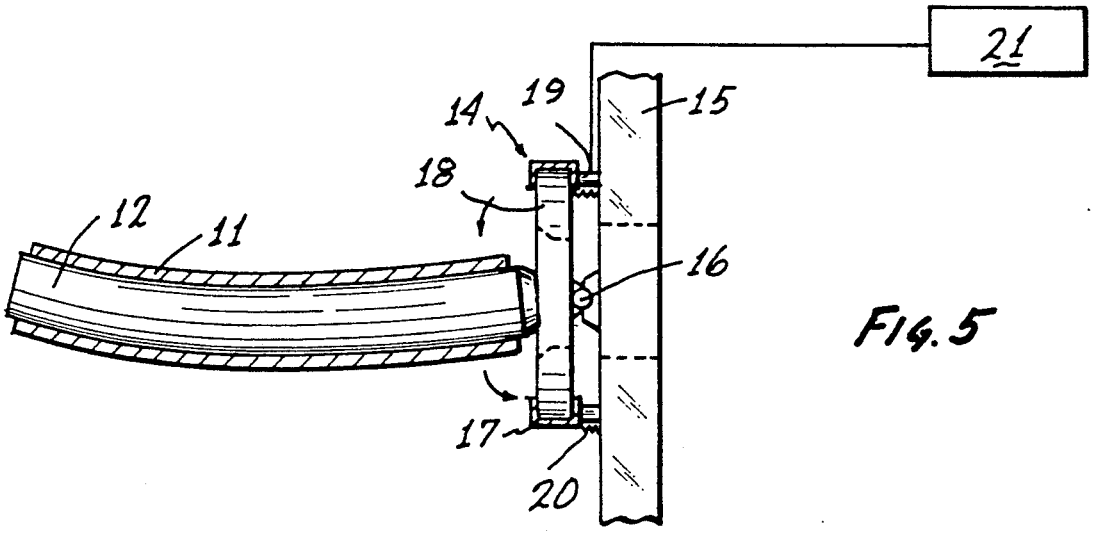

As shown also in FIGS. 5 and 6, the control of the position of the die 18 in relation to the surface of the mandrel may, in addition, be subject to the result of measuring the effective force. For this, a force measuring device, such as suitable gauges 20, are arranged in various suitable positions on the matrix holder 17, to measure the local force as it is effective between the matrix holder and the frame 15. Any differences in measured forces will be evaluated in the processing station 21 which includes micro processors, and converts these signals into control signals effecting the hydraulic drives 19. This operation can optimize the shaping process automatically in accordance with inputted data, for example, on the basis of the desired mold to be made. It is very easy to match the control process towards different dimensions, cross-sections, wall thicknesses, shapes, and qualities of the material being worked.

The invention is not limited to the embodiments described above, but all changes and modifications thereof, not constituting departures from the spirit and scope of the invention are intended to be included.

We claim:

1. Method of making molds for continuous casting machines comprising the steps of:

providing a plurality of different tubular blanks of copper or copper based alloys;

selecting a particular one from among said tubular blanks as stored and feeding same to a first working station;

providing in the first station one end of said selected tubular blank with a thrust mount against which a mandrel to be inserted can abut during subsequent working;

selecting a particular mandrel from among a plurality of stored mandrels, the selected mandrel having an outer contour corresponding to the inner contour of the mold to be made;

placing, in a second work station, the selected mandrel into said selected tubular blank;

pivotally mounting a die in a third station, and forcing by means of the die, the tubular blank onto the mandrel in all around tight surface to surface contact;

acting on the die for positioning the die in relation to the mandrel and the tubular blank as passing through thereby maintaining an orientation of the die to the mandrel and the tubular blank thereon as passing through the die such that a die plane runs at right angles to a center axis of the mandrel, where intersecting said plane;

removing the mandrel in a fourth station from the sized tubular blank;

returning the mandrel either to the second station or to the mandrel store; and removing the sized tubular blank from the equipment.

2. Method as in claim 1, wherein said thrust mount providing step includes providing the tubular blank with a radially inwardly extending bead.

3. Method as in claim 1, wherein said tubular blank and said mandrel are selected such that the deformation and shaping provided in the third station is between 15 and 25% with reference to the original cross-section of the tubular mandrel.

4. Method as in claim 1, the control being provided to maintain normal action of force by the die in relation to the surface of the mandrel.

5. Method as in claim 1, including the step of using mandrels assembled from different parts, the mandrel being disassembled prior to removal from the worked tubular blank in the fourth station.

* * * * *